US010856599B1

(12) United States Patent
Cuenca

(10) Patent No.: US 10,856,599 B1
(45) Date of Patent: Dec. 8, 2020

(54) HARD HAT WITH INTEGRATED ELECTRONIC SYSTEMS

(71) Applicant: Diego Cuenca, Brampton (CA)

(72) Inventor: Diego Cuenca, Brampton (CA)

( * ) Notice: Subject to any disclaimer, the term of this patent is extended or adjusted under 35 U.S.C. 154(b) by 79 days.

(21) Appl. No.: 16/299,250

(22) Filed: Mar. 12, 2019

(51) Int. Cl.
*A42B 3/30* (2006.01)
*A42B 3/04* (2006.01)
*A42B 3/32* (2006.01)

(52) U.S. Cl.
CPC ..... *A42B 1/245* (2013.01); *A42B 3/0406* (2013.01); *A42B 3/30* (2013.01); *A42B 3/303* (2013.01); *A42B 3/306* (2013.01); *A42B 3/324* (2013.01)

(58) Field of Classification Search
CPC ..... A42B 1/245; A42B 3/324; A42B 3/303; A42B 3/306; A42B 3/0406; A42B 3/00; A42B 3/044; A42B 3/30
USPC ..... 455/41.2
See application file for complete search history.

(56) References Cited

U.S. PATENT DOCUMENTS

| | | | | |
|---|---|---|---|---|
| 6,798,392 | B2 | 9/2004 | Hartwell | |
| 7,110,743 | B2 | 9/2006 | Depew | |
| 7,592,911 | B1 | 9/2009 | Hudgens | |
| D748,866 | S | 2/2016 | Tutor | |
| 9,486,027 | B2 | 11/2016 | Dey | |
| 9,549,583 | B2 | 1/2017 | Pietrzak | |
| 9,955,744 | B1 * | 5/2018 | Yanes | A42B 1/248 |
| 2009/0303698 | A1 * | 12/2009 | Huss | A42B 3/044 362/105 |
| 2015/0138354 | A1 * | 5/2015 | Miller | G06Q 10/20 348/143 |
| 2015/0272253 | A1 | 10/2015 | Orientale | |
| 2016/0249700 | A1 * | 9/2016 | Zhavoronkov | A42B 3/042 2/421 |
| 2019/0037174 | A1 * | 1/2019 | Paripally | H04N 5/2252 |

FOREIGN PATENT DOCUMENTS

| | | |
|---|---|---|
| WO | 2014107585 | 7/2014 |

* cited by examiner

*Primary Examiner* — Eugene Yun
(74) *Attorney, Agent, or Firm* — Kyle A. Fletcher, Esq.

(57) ABSTRACT

The hard hat with integrated electronic systems is a hard hat comprising a shell, headband, sweatband, suspension harness, and size adjustment ratchet and knob. The hard hat also comprises electronics, which allow the user to listen to radio broadcasts, determine the time, receive and initiate mobile phone calls, issues voice commands to a paired device, or combinations thereof. A pair of audio transducers mounted adjacent to the ears allows the user to hear radio broadcasts and mobile phone audio. A microphone mounted on the control panel allows the user to talk during a mobile phone call or speak voice commands. A microprocessor within the hard hat controller manages devices and routes signals. A control display and operator controls accessible on the exterior side of the hard hat allows the user to change settings and pair the hard hat with a smart phone.

17 Claims, 5 Drawing Sheets

HARD HAT WITH INTEGRATED ELECTRONIC SYSTEMS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of safety equipment, more specifically, a hard hat with integrated electronic systems.

SUMMARY OF INVENTION

The hard hat with integrated electronic systems is a hard hat comprising a shell, headband, sweatband, suspension harness, and size adjustment ratchet and knob. The hard hat also comprises electronics, which allow the user to listen to radio broadcasts, determine the time, receive and initiate mobile phone calls, issues voice commands to a paired device, or combinations thereof. A pair of audio transducers mounted adjacent to the ears allows the user to hear radio broadcasts and mobile phone audio. A microphone mounted on the hard hat allows the user to talk during a mobile phone call or speak voice commands. A microprocessor within the hard hat controller manages devices and routes signals. A control display and operator controls accessible on the exterior side of the hat allows the user to change settings and pair the hard hat with a smart phone.

An object of the invention is to provide a hard hat for protecting the head of a user wearing the hard hat.

Another object of the invention is to provide the hard hat with a radio receiver and audio transducers for listening to radio broadcasts.

A further object of the invention is to provide a transceiver that pairs with a smart device such as a smart phone.

Yet another object of the invention is to provide a microphone on the hard hat for listening to user voice commands and call audio.

These together with additional objects, features and advantages of the hard hat with integrated electronic systems will be readily apparent to those of ordinary skill in the art upon reading the following detailed description of the presently preferred, but nonetheless illustrative, embodiments when taken in conjunction with the accompanying drawings.

In this respect, before explaining the current embodiments of the hard hat with integrated electronic systems in detail, it is to be understood that the hard hat with integrated electronic systems is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the hard hat with integrated electronic systems.

It is therefore important that the claims be regarded as including such equivalent construction insofar as they do not depart from the spirit and scope of the hard hat with integrated electronic systems. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
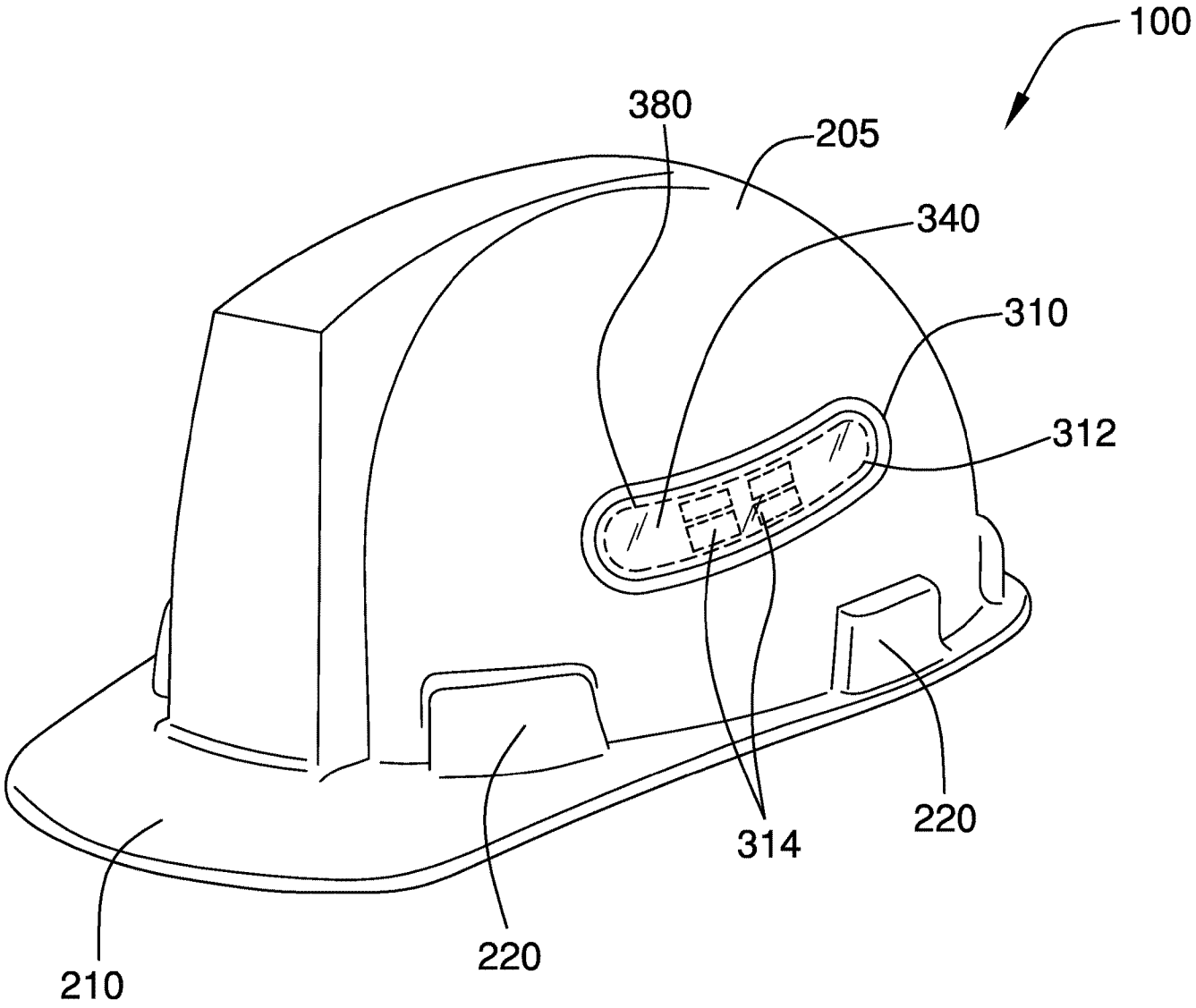
FIG. 1 is a perspective view of an embodiment of the disclosure.
Figure 2:
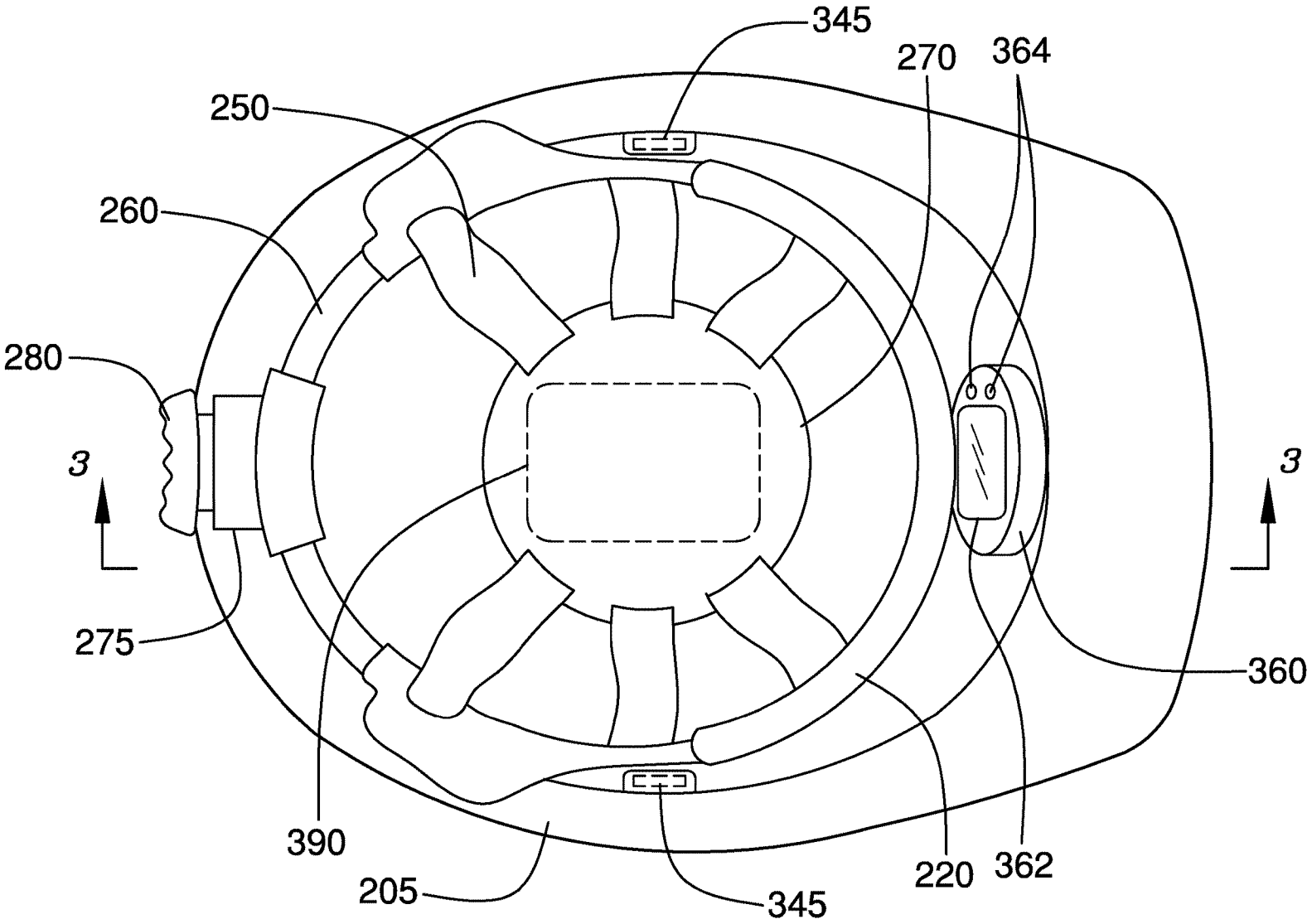
FIG. 2 is a top view of an embodiment of the disclosure.
Figure 3:
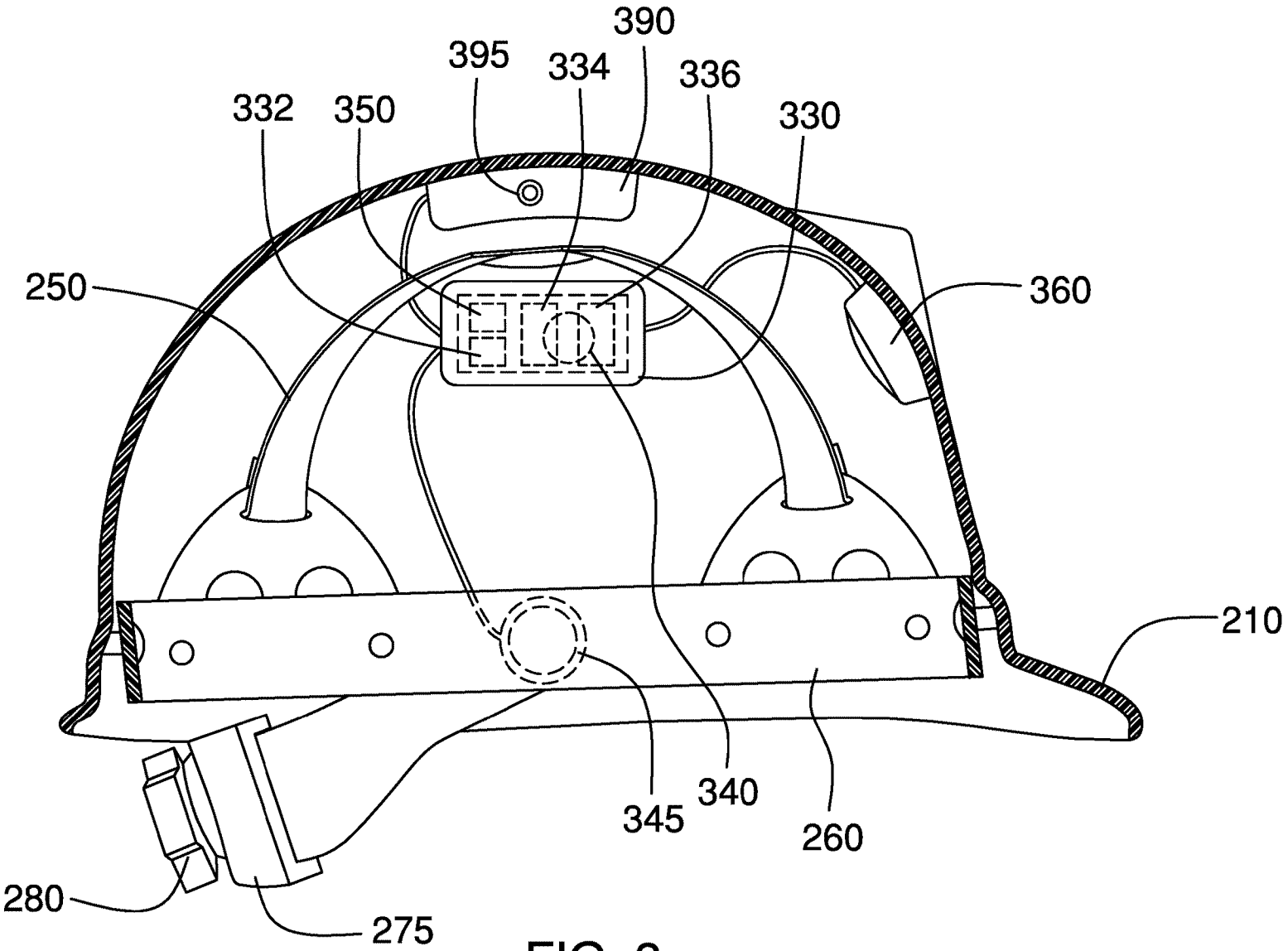
FIG. 3 is a cross-sectional view of an embodiment of the disclosure across 3-3 as shown in FIG. 2.
Figure 4:
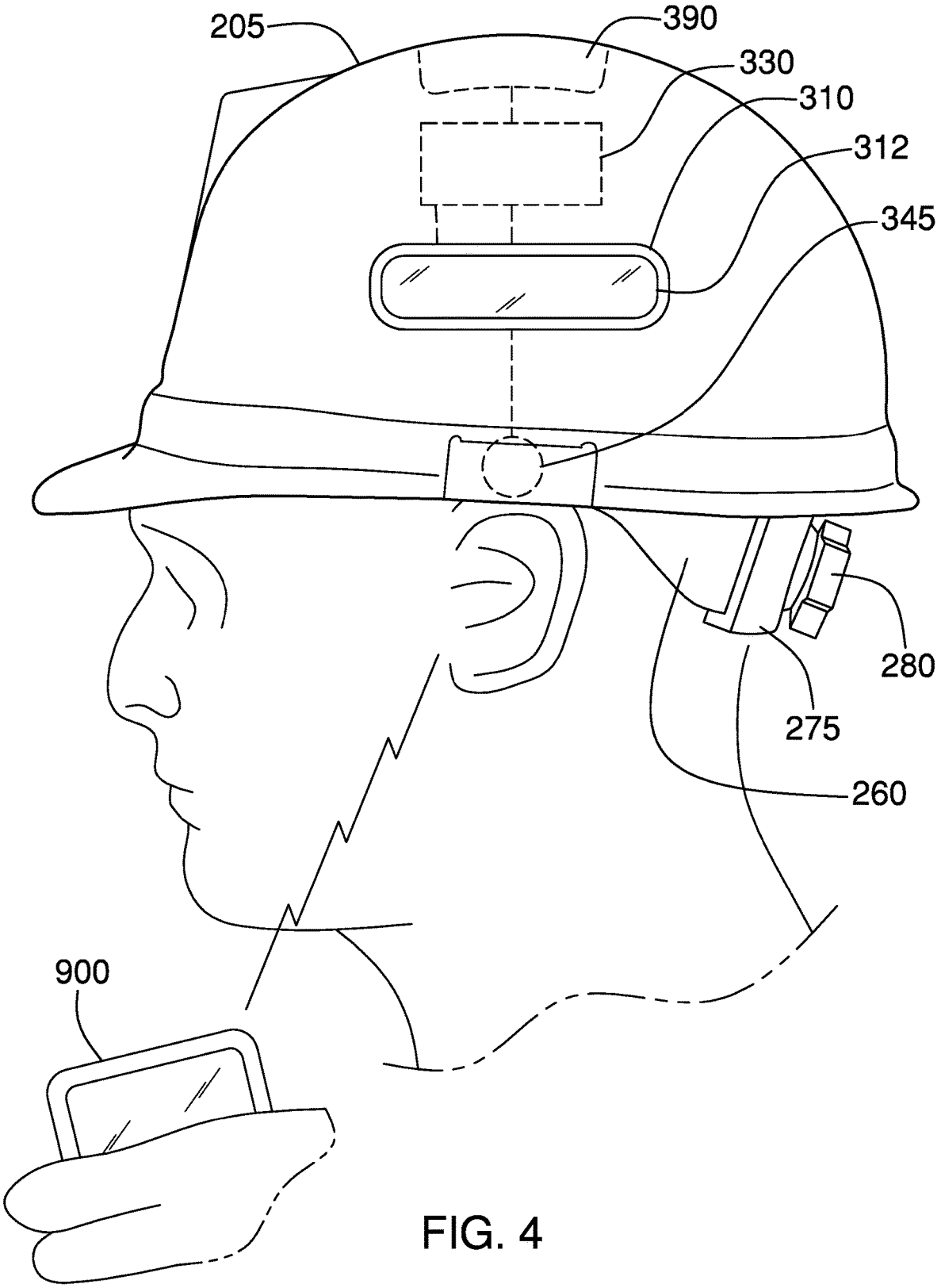
FIG. 4 is an in-use view of an embodiment of the disclosure.
Figure 5:
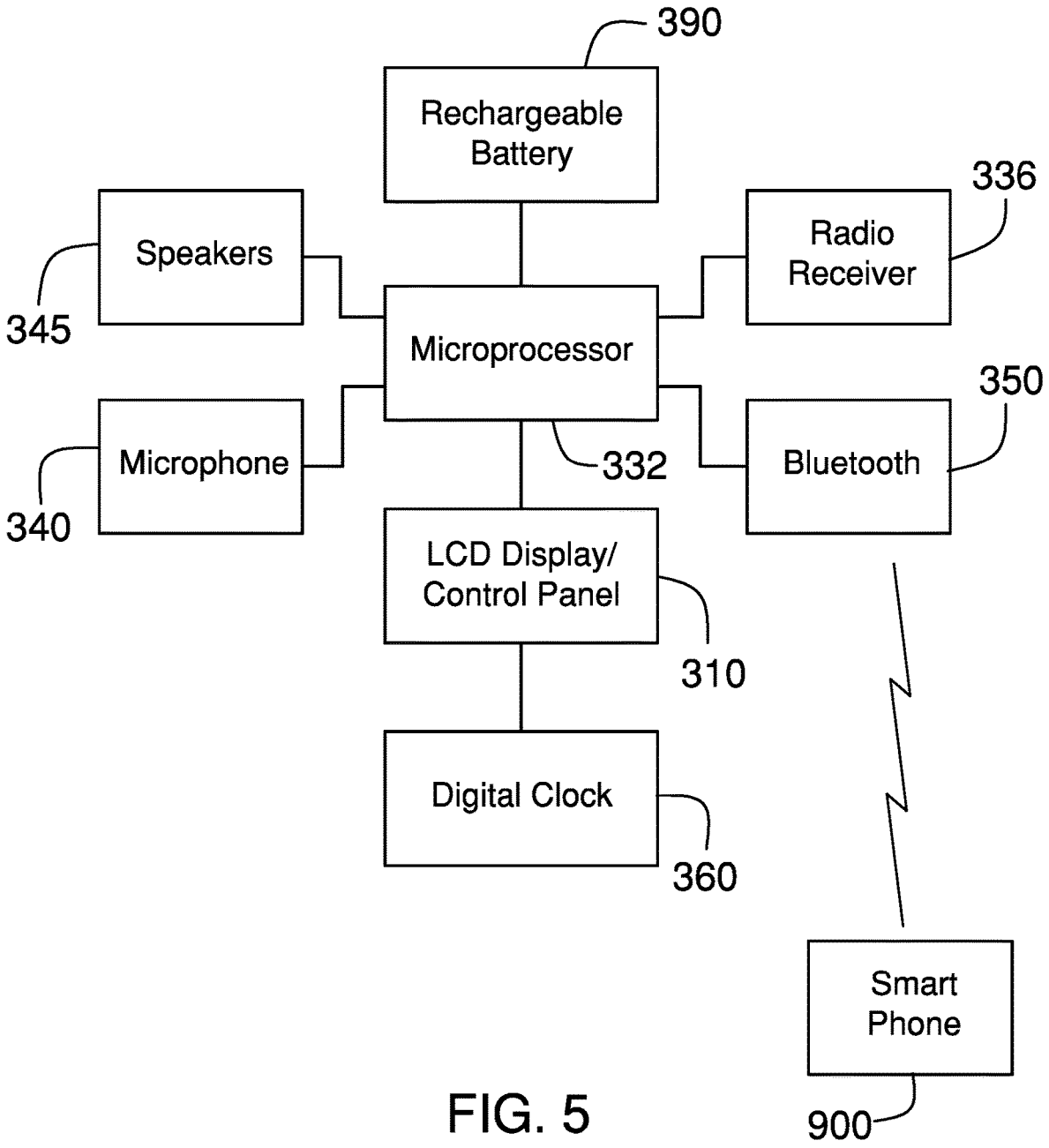
FIG. 5 is a block diagram of an embodiment of the disclosure illustrating interactions between major functional blocks of the invention.

Detailed reference will now be made to a first potential embodiment of the disclosure, which is illustrated in FIGS. 1 through 5.

The hard hat with integrated electronic systems 100 (hereinafter invention) comprises electronics and a hard hat. The invention 100 may be the hard hat that is adapted to play audio and/or voice programming, accept phone calls, report the time of day, accept voice commands on behalf of smart devices, and perform other tasks using the electronics that are integrated into the hard hat.

The electronics comprise a controller 330, a control panel 310, a pair of audio transducers 345, a microphone 340, and a battery 390. The electronics may communicate with a smartphone 900 to receive and/or make the phone calls, may play music, may indicate the time of day, may convert spoken language into commands for other devices, or combinations thereof.

The controller 330 may comprise a microprocessor 332 and a memory 334 wherein the memory 334 contains instructions for causing the microprocessor 332 to control the sequence and timing of pairing, receiving and/or initiating the phone calls, recognizing and acting upon spoken commands, tracking and displaying time, tuning a broadcast radio station, and other features of the invention 100. The controller 330 may further comprise a radio receiver 336 for receiving the audio and/or voice programming transmitted by the broadcast radio station. As non-limiting examples, the broadcast radio stations may include stations broadcasting in the AM broadcast band and stations broadcasting in the FM broadcast band. The audio and/or voice programming may be played through the pair of audio transducers 345 located in the hard hat.

The controller 330 may comprise a wireless transceiver 350. The wireless transceiver 350 may pair with a compatible transceiver in the smartphone 900. The controller 330 may route audio between the microphone 340, the pair of audio transducers 345, and the smartphone 900 via the wireless transceiver 350 such that the controller 330 may manage the phone calls by sending audio impinging upon the microphone 340 to the smartphone 900 and by playing audio received via the smartphone 900 at the pair of audio transducers 345.

The control panel 310 comprises a control display 312, operator controls 314, and the microphone. The control display 312 may be a flat viewing screen that presents text and/or images as illuminated pixels. The determination of which pixels to illuminate is made by the controller 330. The pixels may be arranged in a matrix comprising addressable rows and columns. Moving images may be displayed by presenting a series of still images at a frame rate of 18 images per second or greater. The control display 312 may be LCD technology, LED technology, OLED technology, plasma technology, or other flat-panel display technologies. The control display 312 may comprise a backlight that allows the image to be seen in the dark. The control display 312 may be mounted on an exterior side of the hard hat. The operator controls 314 may be adapted to accept input from a user 910 and convey the input to the controller 330. As non-limiting examples, the operator controls 314 may be a touchscreen 380 overlaying the control display 312 or a plurality of pushbuttons adjacent to the control display 312.

The pair of audio transducers 345 may convert an audio output signal into audible sound. As non-limiting examples, the pair of audio transducers 345 may be one or more loudspeakers or one or more piezoelectric transducers. The audio output signal may be an electrical signal that is modulated by the controller 330. The pair of audio transducers 345 may be mounted on a shell 205, on a head band 260, or a combination thereof. The pair of audio transducers 345 may be adapted to be located at each side of the hard hat adjacent to an ear. The microphone 340 may be a transducer that converts sound into an audio input signal. The audio input signal may be an electrical signal that is passed to the controller 330. The microphone 340 may be one or more dynamic microphone, one or more condenser microphone, or one or more piezoelectric microphone. The microphone 340 may be mounted on the control display 312.

The battery 390 may comprise one or more energy-storage devices. The battery 390 may be a source of electrical energy to operate the microprocessor 332, the memory 334, the radio receiver 336, the wireless transceiver 350, and the control panel 310. The battery 390 may be replaceable or rechargeable. In some embodiments, the battery 390 may be rechargeable by plugging a power adapter into a charging port.

The controller 330 may further comprise a clock 360. The clock 360 may track time and display the current time of day in a clock display 362. The clock 360 may comprise a plurality of clock controls 364 for changing the clock time, mode of operation, and other settings. In some embodiments, the clock display 362 may be the same as the control display 312, the plurality of clock controls 364 may be a subset of the operator controls 314, and time-keeping functions of the clock 360 may be implemented within the controller 330.

The hard hat comprises the shell 205, the head band 260, a harness 250, a ratchet 275, and a sweatband 265. The hard hat may be a helmet adapted to protect the head of the user 910. The shell 205 may be a dome shaped covering that comprises the top of the hard hat. The shell 205 may be adapted to cover the head of the user 910 from ear to ear and from brow to nape. The shell 205 may comprise a peak 210 which may be a visor extending forward from the bottom front rim of the shell 205. The shell 205 may comprise a plurality of slots, which may be vertically oriented indentations into which a plurality of tabs may slide to couple the head band 260 to the shell 205. The shell 205 may comprise a plurality of shell protrusions 220 which may be outwards extensions of the shell 205 to provide space for component mounting. As non-limiting examples, the plurality of slots, the controller 330, the control panel 310, the clock 360, the battery 390, the pair of audio transducers 345, or combinations thereof may be placed into the plurality of shell protrusions 220 in some embodiments.

The head band 260 may be a strap that is adapted to horizontally encircle the head of the user 910. The head band 260 may be adapted to be the point of contact between the head of the user 910 and the hard hat. The plurality of tabs may be coupled to the head band 260 and the plurality of tabs may in turn removably couple to the plurality of slots by sliding into the plurality of slots. The head band 260 may comprise a gap at the rear of the hard hat so that the size of the head band 260 may be adjusted by pulling or releasing the free ends of the head band 260.

The harness 250 may be a plurality of flexible straps coupled at each end to the head band 260 and criss-crossing the center of the hard hat. In some embodiments, the harness 250 may comprise a center disk 270 at the center of the hard hat where the straps of the harness 250 cross each other. The center disk 270 may keep the straps spaced evenly.

The ratchet 275 may be a linear tightener that tightens the head band 260 by pulling opposing ends of the head band 260 or loosens the head band 260 by spreading the opposing ends of the head band 260. The ratchet 275 may be tightened or loosened by turning a knob 280 at the rear of the hard hat.

The sweatband 265 may be absorbent material wrapped around the head band 260 at the front of the head band 260 for the purpose of absorbing moisture.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object.

"Upper" refers to top and "lower" refers to the bottom. As a non-limiting example, the upper end of a vertical shaft is the top end of the vertical shaft.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "clock" is an instrument that measures the passage of time. Clocks are often synchronized to a reference time that allows for communities to coordinate the scheduling of activities.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", refer to connecting, either directly or indirectly, and does not necessarily imply a mechanical connection.

As used in this disclosure, a "display" is a surface upon which is presented an image, potentially including, but not limited to, graphic images and text, that is interpretable by an individual viewing the image. When used as a verb, "display" is defined as presenting such an image.

As used herein, the term "dome shaped" is used to describe an object having a convex shape and a round perimeter.

As used in this disclosure, the word "exterior" is used as a relational term that implies that an object is not located or contained within the boundary of a structure or a space.

As used in this disclosure, "flexible" refers to an object or material which will deform when a force is applied to it, which will not return to its original shape when the deforming force is removed, and which may not retain the deformed shape caused by the deforming force.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, an "image" is an optical representation or reproduction of an indicia or of the appearance of something or someone.

As used in this disclosure, "LCD" is an acronym for Liquid Crystal Display. A liquid crystal display comprises a liquid crystal film placed between two sheets of transparent material. The visual characteristics of the LCD can be varied through the application of a voltage.

As used in this disclosure, an "LED" is an acronym for a light emitting diode. An LED allows current to flow in one direction and when current is flowing the LED emits photons. The wavelength of the light that is emitted may be in the visible range of the spectrum or may extend into either the infrared (IR) spectral range or the ultraviolet (UV) spectral range. The brightness of the LED can be increased and decreased by controlling the amount of current flowing through the LED. Multiple LEDs having different emission spectrums may be packaged into a single device to produce a multi-color LED. A broad range of colors may be produced by multi-color LEDs by selecting which of the multiple LEDs are energized and by controlling the brightness of each of the multiple LEDs. Organic LEDs (OLEDs) are included in this definition.

As used in this disclosure, a "microphone" is a transducer that converts the energy from vibration into electrical energy. The sources of vibrations include, but are not limited to, acoustic energy.

As used herein, "pair", "paired", and "pairing" refer to a connection established between two wireless devices.

As used herein, the terms "processor", "central processor", "central processing unit", "CPU", or "microprocessor" refer to a digital device that carries out the instructions comprising a computer program by performing basic arithmetic, logical, control, and input/out operations. The term "microprocessor" may additionally imply a level of miniaturization and power reduction that makes the device suitable for portable or battery operated systems.

As used in this disclosure, a "rim" is an outer edge or border that follows along the perimeter of an object.

As used in this disclosure, a "shell" is a structure that forms an outer covering intended to contain an object. Shells are often, but not necessarily always, rigid or semi-rigid structures that are intended to protect the object contained within it. Some shells may only partially cover the exterior surface of the object.

As used in this disclosure a "strap" is a strip of leather, cloth, nylon, plastic, thin metal, rubber, or other flexible material, that is used to fasten, secure, carry, or hold onto something. A strap is sometimes used in conjunction with a buckle.

As used in this disclosure, a "touchscreen" is an interface that allows a user to interface with a logical device by touching the image bearing surface of a display.

As used in this disclosure, a "transceiver" is a device that is used to transmit and/or receive signals. The signals may be audible, optical, or RF in nature.

As used in this disclosure, a "transducer" is a device that converts a physical quantity, such as pressure or brightness into an electrical signal or a device that converts an electrical signal into a physical quantity.

As used in this disclosure, "wireless" is an adjective that is used to describe a communication channel that does not require the use of physical cabling.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A hard hat with integrated electronic systems comprising:

electronics and a hard hat;

wherein the hard hat with integrated electronic systems is adapted to play audio and/or voice programming, accept phone calls, report the time of day, accept voice commands on behalf of smart devices, and perform other tasks using the electronics that are integrated into the hard hat;

wherein the electronics comprise a controller, a control panel, a pair of audio transducers, a microphone, and a battery;

wherein the electronics communicate with a smartphone to receive and/or make the phone calls, play music, indicate the time of day, convert spoken language into commands for other devices, or combinations thereof;

wherein the control panel comprises a control display, operator controls, and the microphone;

wherein the control display is a flat viewing screen that presents text and/or images as illuminated pixels;

wherein the determination of which pixels to illuminate is made by the controller;

wherein the pixels are arranged in a matrix comprising addressable rows and columns;

wherein moving images are displayed by presenting a series of still images at a frame rate of 18 images per second or greater;

wherein the control display is LCD technology, LED technology, OLED technology, plasma technology, or another flat-panel display technology;

wherein the control display comprises a backlight that allows the image to be seen in the dark;

wherein the control display is mounted on an exterior side of the hard hat;

wherein the operator controls are adapted to accept input from a user and convey the input to the controller.

2. The hard hat with integrated electronic systems according to claim 1 wherein the controller comprises a microprocessor and a memory; wherein the memory contains instructions for causing the microprocessor to control the sequence and timing of pairing, receiving and/or initiating the phone calls, recognizing and acting upon spoken commands, tracking and displaying time, tuning a broadcast radio station, and other features of the hard hat with integrated electronic systems.

3. The hard hat with integrated electronic systems according to claim 2 wherein the controller comprises a radio receiver for receiving the audio and/or voice programming transmitted by the broadcast radio station;

wherein the audio and/or voice programming is played through the pair of audio transducers located in the hard hat.

4. The hard hat with integrated electronic systems according to claim 3 wherein the controller comprises a wireless transceiver;

wherein the wireless transceiver pairs with a transceiver in the smartphone;

wherein the controller routes audio between the microphone, the pair of audio transducers, and the smartphone via the wireless transceiver such that the controller manages the phone calls by sending audio impinging upon the microphone to the smartphone and by playing audio received via the smartphone at the pair of audio transducers.

5. The hard hat with integrated electronic systems according to claim 4 wherein the operator controls comprise a touchscreen overlaying the control display or a plurality of pushbuttons adjacent to the control display.

6. The hard hat with integrated electronic systems according to claim 4 wherein the pair of audio transducers convert an audio output signal into audible sound.

7. The hard hat with integrated electronic systems according to claim 6 wherein the pair of audio transducers are one or more loudspeakers or one or more piezoelectric transducers;

wherein the audio output signal is an electrical signal that is modulated by the controller;

wherein the pair of audio transducers are mounted on a shell, on a head band, or a combination thereof;

wherein the pair of audio transducers are adapted to be located at each side of the hard hat adjacent to an ear;

wherein the microphone is a transducer that converts sound into an audio input signal;

wherein the audio input signal is an electrical signal that is passed to the controller;

wherein the microphone is one or more dynamic microphone, one or more condenser microphone, or one or more piezoelectric microphone.

8. The hard hat with integrated electronic systems according to claim 7 wherein the battery comprises one or more energy-storage devices;

wherein the battery is a source of electrical energy to operate the microprocessor, the memory, the radio receiver, the wireless transceiver, and the control panel;

wherein the battery is replaceable or rechargeable.

9. The hard hat with integrated electronic systems according to claim 8 wherein the battery is rechargeable by plugging a power adapter into a charging port.

10. The hard hat with integrated electronic systems according to claim 8 wherein the controller comprises a clock;

wherein the clock tracks time and displays the current time of day in a clock display;

wherein the clock comprises a plurality of clock controls for changing the clock time, mode of operation, and other settings.

11. The hard hat with integrated electronic systems according to claim 10 wherein the clock display is the same as the control display, the plurality of clock controls are a subset of the operator controls, and time-keeping functions of the clock are implemented within the controller.

12. The hard hat with integrated electronic systems according to claim 10 wherein the hard hat comprises the shell, the head band, a harness, a ratchet, and a sweatband;

wherein the hard hat is a helmet adapted to protect the head of the user;

wherein the shell is a dome shaped covering that comprises the top of the hard hat;

wherein the shell is adapted to cover the head of the user from ear to ear and from brow to nape;

wherein the shell comprises a peak which is a visor extending forward from the bottom front rim of the shell;

wherein the shell comprises a plurality of shell protrusions which are outward extensions of the shell to provide space for component mounting.

13. The hard hat with integrated electronic systems according to claim 12 wherein the head band is a strap that is adapted to horizontally encircle the head of the user;

wherein the head band is adapted to be the point of contact between the head of the user and the hard hat;

wherein the head band comprises a gap at the rear of the hard hat so that the size of the head band is adjusted by pulling or releasing the free ends of the head band.

14. The hard hat with integrated electronic systems according to claim 13 wherein the harness is a plurality of flexible straps coupled at each end to the head band and criss-crossing the center of the hard hat.

15. The hard hat with integrated electronic systems according to claim 14 wherein the harness comprises a center disk at the center of the hard hat where the straps of the harness cross each other;

wherein the center disk keeps the straps spaced evenly.

16. The hard hat with integrated electronic systems according to claim 14 wherein the ratchet is a linear tightener that tightens the head band by pulling opposing ends of the head band or loosens the head band by spreading the opposing ends of the head band;

wherein the ratchet is tightened or loosened by turning a knob at the rear of the hard hat.

17. The hard hat with integrated electronic systems according to claim 16 wherein the sweatband is absorbent material wrapped around the head band at the front of the head band for the purpose of absorbing moisture.

* * * * *